US010995451B2

(12) United States Patent
Kuang

(10) Patent No.: US 10,995,451 B2
(45) Date of Patent: May 4, 2021

(54) ENVIRONMENTALLY-FRIENDLY PROCESSING METHOD FOR DYEING DENIM FABRIC WITH ZERO DISCHARGE

(71) Applicant: Kaiping Panther Textiles Co., Ltd., Kaiping (CN)

(72) Inventor: Di Tian Kuang, Kaiping (CN)

(73) Assignee: KAIPING PANTHER TEXTILES CO., LTD., Kaiping (CN)

( * ) Notice: Subject to any disclaimer, the term of this patent is extended or adjusted under 35 U.S.C. 154(b) by 0 days.

(21) Appl. No.: 16/675,899

(22) Filed: Nov. 6, 2019

(65) Prior Publication Data

US 2021/0040685 A1 Feb. 11, 2021

(30) Foreign Application Priority Data

Aug. 8, 2019 (CN) ..... 201910728335.8

(51) Int. Cl.

| | |
|---|---|
| ***D06P 5/00*** | (2006.01) |
| ***D06P 5/08*** | (2006.01) |
| ***D06P 3/40*** | (2006.01) |
| ***D06P 5/20*** | (2006.01) |

(52) U.S. Cl.
CPC ..... *D06P 5/08* (2013.01); *D06P 3/40* (2013.01); *D06P 5/2072* (2013.01)

(58) Field of Classification Search
CPC .. D06P 5/08; D06P 5/2072; D06P 3/40; D06P 1/0036
USPC ..... 8/494, 495
See application file for complete search history.

(56) References Cited

U.S. PATENT DOCUMENTS 5,951,719 A * 9/1999 Cooper ..... D06P 5/08 427/324

* cited by examiner

*Primary Examiner* — Eisa B Elhilo
(74) *Attorney, Agent, or Firm* — Muncy, Geissler, Olds & Lowe, P.C.

(57) ABSTRACT

The present invention relates to the field of denim fabric processing, specifically to an environmentally-friendly processing method for dyeing denim fabric with zero discharge. The method includes: step 1, a treatment of white warp yarns; step 2, a primary drying operation; step 3, a coating spray-dyeing operation; step 4, a secondary drying operation; step 5, a sizing operation; step 6, a ternary drying operation; and step 7, a doffing operation. In the present application, as warp yarns are dyed using the coating spray-dyeing technology, highly corrosive auxiliaries such as sodium hydrosulfite and sodium sulfide are not needed in the dyeing process, and the dyed warp yarns are not required to be treated in a washing tank, so that zero effluent discharge is achieved.

7 Claims, No Drawings

ENVIRONMENTALLY-FRIENDLY PROCESSING METHOD FOR DYEING DENIM FABRIC WITH ZERO DISCHARGE

TECHNICAL FIELD

The present invention relates to the field of denim fabric processing, specifically to an environmentally-friendly processing method for dyeing denim fabric with zero discharge.

BACKGROUND

Dyeing is a very common craft, which refers to a process of dyeing fabric in various colors. Various dyeing agents and auxiliaries need to be added in a dyeing machine. The features of fabric vary with fabric categories. For example, dyeing quality can be influenced by shrinking percentage, and therefore dyeing process changes accordingly. Denim fabric is one of popular fabric in trend. Traditional dyeing methods consume a huge amount of water and are high in cost when used to dye the denim fabric.

Warp yarns of the regular color denim fabric are dyed by continuous dip-dyeing and oxidization with sulfur dyestuff in a sizing-dyeing integrated machine (the dyeing process includes steps of pre-treatment of white warp yarns, fixation operation (dip-dyeing and oxidation) which is repeated for 2-4 times, water washing, soaping, washing, drying, sizing, drying, and doffing). Since sulfur dyestuff cannot be directly dissolved in water and has a feature of no affinity to fibers, a large amount of sodium sulfide is required at a high temperature during dyeing to reduce and dissolve the sulfur dyestuff for dyeing the fabric, and washing and soaping treatment are required after dyeing. Therefore, the whole dyeing process which consumes a huge amount of water, electricity and steam and generates a large amount of sewage to be purified is a dyeing approach that causes too much pollution. Besides, ready-made clothes also generate a large amount of sewage when washed with water. Moreover, the color denim fabric generated using the sulfur dyestuff also has disadvantages of lacking colors hue and brightness, being irresistible to bleaching, being crisp during storage, etc.

SUMMARY OF THE INVENTION

The objective of the present invention is to provide an environmentally-friendly processing method for dyeing denim fabric with zero discharge to solve defects mentioned above.

To fulfill the above objective, the present invention employs the following technical solution:

An environmentally-friendly processing method for dyeing denim fabric with zero discharge comprises:

step 1, a treatment of white warp yarns, including sub-steps of selecting white warp yarns, sewing edges of the white warp yarns using a sewing machine, removing thread residues, spreading out and placing the treated warp yarns in a Teflon drying barrel, increasing the temperature inside the drying barrel with high-temperature steam for 10-15 min, turning off a heating device to let the warp yarns to cool, then placing the cooled warp yarns in a plasma barrel, and performing plasma drying treatment on surfaces of the warp yarns at normal pressure for 10-15 min, and obtaining a pre-processed material A;

step 2, a primary drying operation, including sub-steps of placing and spreading out the pre-processed material A in an drying chamber, increasing the temperature inside the drying barrel to a high operation temperature within the range of 135-150° C. first, maintaining the temperature for 30 min, then decreasing the temperature inside the drying chamber to a temperature within the range of 45-55° C., maintaining the temperature for 10 min, then turning off the heating device, and after the heated material gets cool, obtaining a processed material B;

step 3, a coating spray-dyeing operation, including sub-steps of placing and spreading out the processed material B in a spray-dyeing chamber, loading a spray-dyeing solvent, increasing the temperature inside the spray-dyeing chamber to a temperature within the range of 65-75° C., maintaining the temperature for 10 min, then turning off the heating device, performing spray-dyeing operation, and obtaining a semi-finished product C;

step 4, a secondary drying operation, including sub-steps of placing and spreading out the semi-finished product C on a bearing panel in the drying chamber, increasing the temperature inside the drying chamber to a temperature within the range of 170-190° C., maintaining the temperature for 10 min, decreasing the temperature inside the drying chamber to a temperature within the range of 50-55° C., maintaining the temperature for 5 min, and after the material gets cool, obtaining a semi-finished product D;

step 5, a sizing operation, including sub-steps of loading a prepared sizing solution onto a sizing machine, spreading out the semi-finished product D on the sizing machine, performing sizing operation at a yarn speed of 30 m/min and a tank temperature of over 95° C., and obtaining a semi-finished product E after the sizing operation is completed;

step 6, a ternary drying operation, including sub-steps of placing and spreading out the semi-finished product E on the bearing panel in the drying chamber, increasing the temperature inside the drying chamber to a temperature within the range of 130-150° C., maintaining the temperature for 5 min, continuously decreasing the temperature of the drying chamber to the temperature of 60° C., maintaining the temperature for 10 min, turning off the heating device after a size film is formed on the surfaces of the warp yarns, and after the heated material gets cool, obtaining a pre-fabricated product F;

step 7, a doffing operation, including sub-steps of uniformly spraying a softening agent on the surface of denim fabric, performing doffing operation at a lathe speed of 40 m/min and a heating temperature within the range of 130~150° C. and under a pressure within the range of 10-12 MPa, and after the shape of the fabric is fixed, obtaining a finished product G.

As a further solution of the present invention, the dyeing solution is prepared in a weight proportion of 5-10 mL/Kg, and the ratio of the dyeing solution to clean water is 1:7.

As a further solution of the present invention, the dyeing solution includes glacial acetic acid, a leveling agent and a penetrating agent, and the mass ratio of the glacial acetic acid to the leveling agent to the penetrating agent is 2%:2%:1%.

As a further solution of the present invention, the sizing solution is prepared in a weight proportion of 3.5-5 mL/Kg, and the ratio of the sizing solution to clean water is 1:4.

As a further solution of the present invention, the sizing solution is prepared by the following ingredients in part by mass: 120 parts of SC-14 starch, 25 parts of LMA-95 synthetic sizing agent, 16 parts of emulsified oil and 15 parts of smoothing agent.

As a further solution of the present invention, the softening agent is prepared by the following ingredients in part by mass: 25 parts of sodium benzoate, 11 parts of octamethyl cyclotetrasiloxane, 10 parts of sodium stearate, 15 parts of hydroxypropyl methylcellulose, 5 parts of polyvinyl alcohol, 2 parts of sodium oleate, 2 parts of sodium tripolyphosphate, and 2 parts of lauryl sodium sulfate.

As a further solution of the present invention, the temperature for the secondary drying operation is 35-40° C. higher than the temperature for the primary drying operation, and the temperature for ternary drying operation is 35-40° C. lower than the temperature for the secondary drying operation.

As a further solution of the present invention, the temperature for the ternary drying operation is unstable, maintained until the surfaces of the warp yarns are covered with the size film.

Compared with the prior art, the present invention has the following beneficial effects:

I. In the present application, for the environmentally-friendly novel color denim fabric which is dyed without water, as warp yarns are dyed using the coating spraying technology, highly corrosive auxiliaries such as sodium hydrosulfite and sodium sulfide are not needed in the dyeing process, and the dyed warp yarns do not need to be treated in a washing tank, so that zero effluent discharge is achieved.

II. In the present application, the white warp yarns are particularly pre-treated, enhancing the dyed pick-up by over 15%, increasing the ratio of the coating adhesive, and improving the colorfastness of dry rub and wet rub. The whole dyeing process is free of formaldehyde and other harmful substances, and can meet the SGS testing standard.

III. Fabric can be simply post-treated to have a comfortable hand feel; and ready-made clothes can present a wash-fading effect similar to that of indigo and sulfur dyestuff when washed with water, applicable to various water washing approaches; the ready-made fabric has features of soft hand feel, high color fastness, and brilliant color and luster. The problems such as stiff hand feel and dull color and cluster of the traditional pigment dyed fabric are solved.

It should be understood that the above general description and the detailed description the following context are exemplary and explanatory, which cannot be regarded as limit to the present application.

DETAILED DESCRIPTION OF THE INVENTION

Obviously, the described embodiments are only a part of embodiments in the present invention, and not all the embodiments of the present invention. Based on the embodiments in the present invention, those ordinarily skilled in the art can obtain other embodiments without creative labor, which all should fall within the protective scope of the present invention.

Embodiment 1

An environmentally-friendly processing method for dyeing denim fabric with zero discharge includes the following steps:

Step 1, a treatment of white warp yarns, which includes sub-steps of selecting white warp yarns, sewing edges of the white warp yarns using a sewing machine, removing thread residues, spreading out and placing the treated warp yarns in a Teflon drying barrel, increasing the temperature inside the drying barrel with high-temperature steam for 10-15 min, turning off a heating device to let the warp yarns to cool, then placing the cooled warp yarns in a plasma barrel, and performing plasma drying treatment on surfaces of the warp yarns at normal pressure for 10-15 min, and obtaining a pre-processed material A.

Step 2, a primary drying operation, which includes sub-steps of placing and spreading out the pre-processed material A in an drying chamber, increasing the temperature inside the drying chamber to the high operation temperature of 135° C. first, maintaining the temperature for 30 min, then decreasing the temperature inside the drying chamber to a temperature within the range of 45-55° C., maintaining the temperature for 10 min, then turning off the heating device, and after the material gets cool, obtaining a processed material B.

Step 3, a coating spray-dyeing operation, which includes sub-steps of placing and spreading out the processed material B in a spray-dyeing chamber, loading a spray-dyeing solvent, increasing the temperature inside the spray-dyeing chamber to a temperature within the range of 65-75° C., maintaining the temperature for 10 min, then turning off the heating device, and performing spray-dyeing operation to obtain a semi-finished product C, wherein the dyeing solution is prepared in a weight proportion of 5-10 mL/Kg, and the ratio of the dyeing solution to clean water is 1:7; wherein the dyeing solution includes glacial acetic acid, a leveling agent and a penetrating agent, and the mass ratio of the glacial acetic acid to the leveling agent to the penetrating agent is 2%: 2%: 1%.

Step 4, a secondary drying operation, which includes sub-steps of placing and spreading out the semi-finished product C on a bearing panel in the drying chamber, increasing the temperature inside the drying chamber to the temperature of 175° C., keeping the semi-finished product C at such temperature for 10 min, decreasing the temperature inside the drying chamber to a temperature within the range of 50-55° C., maintaining the temperature for 5 min, and after the heated material gets cool, obtaining a semi-finished product D.

Step 5, a sizing operation, which includes a sub-step of loading a prepared sizing solution onto a sizing machine, wherein ratio of the sizing solution to clean water is 1:4, and the sizing solution is prepared by the following ingredients in part by mass: 120 parts of SC-14 starch, 25 parts of LMA-95 synthetic sizing agent, 16 parts of emulsified oil and 15 parts of smoothing agent.

The sizing operation also includes sub-steps of spreading out the semi-finished product D on the sizing machine, performing sizing operation at a yarn speed of 30 m/min and a tank temperature of over 95° C., and obtaining a semi-finished product E after the sizing operation is completed; wherein the sizing solution is prepared in a weight proportion of 3.5-5 mL/Kg.

Step 6, a ternary drying operation, which includes sub-steps of placing and spreading out the semi-finished product E on a bearing panel in the drying chamber, increasing the temperature inside the drying chamber to the temperature of 135° C., maintaining the temperature for 5 min, continuously decreasing the temperature of the drying chamber to the temperature of 60° C., maintaining the temperature for 10 min, turning off a heating unit after a size film is formed on the surfaces of the warp yarns, and after the heated material gets cool, obtaining a pre-fabricated product F.

Step 7, a doffing operation, which includes homogeneously spraying a softening agent onto the surface of the denim fabric, wherein the softening agent is prepared by the following ingredients in part by mass: 25 parts of sodium benzoate, 11 parts of octamethyl cyclotetrasiloxane, 10 parts of sodium stearate, 15 parts of hydroxypropyl methylcellulose, 5 parts of polyvinyl alcohol, 2 parts of sodium oleate, 2 parts of sodium tripolyphosphate, and 2 parts of lauryl sodium sulfate;

The doffing operation is carried out at a lathe speed of 40 m/min, a heating temperature within the range of 130~150° C. and a pressure within the range of 10~12 MPa, and after the material is sized, the finished product G is obtained.

Embodiment 2

As a further solution of embodiment 1, the present application includes the following steps:

Step 1, a treatment of white warp yarns, which includes sub-steps of selecting white warp yarns, sewing edges of the white warp yarns using a sewing machine, removing thread residues, spreading out and placing the treated warp yarns in a Teflon drying barrel, increasing the temperature inside the drying barrel with high-temperature steam for 10-15 min, turning off a heating device to let the warp yarns to cool, then placing the cooled warp yarns in a plasma barrel, and performing plasma drying treatment on surfaces of the warp yarns at normal pressure for 10-15 min, and obtaining a pre-processed material A.

Step 2, a primary drying operation, which includes sub-steps of placing and spreading out the pre-processed material A in an drying chamber, increasing the temperature inside the drying chamber to the high operation temperature of 150° C., maintaining the temperature for 30 min, then decreasing the temperature inside the drying chamber to a temperature within the range of 45-55° C., maintaining the temperature for 10 min, then turning off the heating device, and the heated material gets cool, obtaining a processed material B.

Step 3, a coating spray-dyeing operation, which includes sub-steps of placing and spreading out the processed material B in a spray-dyeing chamber, loading a spray-dyeing solvent, increasing the temperature inside the spray-dyeing chamber to a temperature within the range of 65-75° C., maintaining the temperature for 10 min, then turning off the heating device, and performing spray-dyeing operation to obtain a semi-finished product C, wherein the dyeing solution is prepared in a weight proportion of 5-10 mL/Kg, and the ratio of the dyeing solution to clean water is 1:7; wherein the dyeing solution includes glacial acetic acid, a leveling agent and a penetrating agent, and the mass ratio of the glacial acetic acid to the leveling agent to the penetrating agent is 2%: 2%: 1%.

Step 4, a secondary drying operation, which includes sub-steps of placing and spreading out the semi-finished product C on a bearing panel in the drying chamber, increasing the temperature inside the drying chamber to the temperature of 190° C., maintaining the temperature for 10 min, decreasing the temperature inside the drying chamber to a temperature within the range of 50-55° C., maintaining the temperature for 5 min, and after the semi-finished product C gets cool, obtaining a semi-finished product D.

Step 5, a sizing operation, which includes a sub-step of loading a prepared sizing solution onto a sizing machine, wherein ratio of the sizing solution to clean water is 1:4, and the sizing solution is prepared by the following ingredients in part by mass: 120 parts of SC-14 starch, 25 parts of LMA-95 synthetic sizing agent, 16 parts of emulsified oil and 15 parts of smoothing agent.

The sizing operation also includes a sub-step of spreading out the semi-finished product D on the sizing machine, performing sizing operation at a yarn speed of 30 m/min and a tank temperature of over 95° C., and obtaining a semi-finished product E after the sizing operation is completed; wherein the sizing solution is prepared in a weight proportion of 3.5-5 mL/Kg;

Step 6, a ternary drying operation, which includes sub-steps of placing and spreading out the semi-finished product E on a bearing panel in the drying chamber, increasing the temperature inside the drying chamber to the temperature of 150° C., maintaining the temperature for 5 min, continuously decreasing the temperature of the drying chamber to the temperature of 60° C., maintaining the temperature for 10 min, turning off a heating unit after a size film is formed on the surfaces of the warp yarns, and after heated material gets cool, obtaining a pre-fabricated product F.

Step 7, a doffing operation, which includes homogeneously spraying a softening agent onto the surface of the denim fabric, wherein the softening agent is prepared by the following ingredients in part by mass: 25 parts of sodium benzoate, 11 parts of octamethyl cyclotetrasiloxane, 10 parts of sodium stearate, 15 parts of hydroxypropyl methylcellulose, 5 parts of polyvinyl alcohol, 2 parts of sodium oleate, 2 parts of sodium tripolyphosphate, and 2 parts of lauryl sodium sulfate;

The doffing operation is carried out at a lathe speed of 40 m/min, a heating temperature within the range of 130~150° C. and a pressure within the range of 10~12 MPa, and after the material is sized, the finished product G is obtained.

Embodiment 3

As a further solution of the above embodiments, the present application provides an environmentally-friendly method for dyeing denim fabric with zero discharge, including:

Step 1, a treatment of white warp yarns, which includes sub-steps of selecting white warp yarns, sewing edges of the white warp yarns using a sewing machine, removing thread residues, spreading out and placing the treated warp yarns in a Teflon drying barrel, increasing the temperature inside the drying barrel with high-temperature steam for 10-15 min, turning off a heating device to let the warp yarns to cool, then placing the cooled warp yarns in a plasma barrel, and performing plasma drying treatment on surfaces of the warp yarns at normal pressure for 10-15 min, and obtaining a pre-processed material A.

Step 2, a primary drying operation, which includes sub-steps of placing and spreading out the pre-processed material A in an drying chamber, increasing the temperature inside the drying chamber to the high operation temperature of 145° C. first, maintaining the temperature for 30 min, then decreasing the temperature inside the drying chamber to a temperature within the range of 45-55° C., maintaining the temperature for 10 min, then turning off the heating device, and after the material gets cool, obtaining a processed material B.

Step 3, a coating spray-dyeing operation, which includes sub-steps of placing and spreading out the processed material B in a spray-dyeing chamber, loading a spray-dyeing solvent, increasing the temperature inside the spray-dyeing chamber to a temperature within the range of 65-75° C., maintaining the temperature for 10 min, then turning off the heating device, and performing spray-dyeing operation to obtain a semi-finished product C, wherein the dyeing solution is prepared in a weight proportion of 5-10 mL/Kg, and the ratio of the dyeing solution to clean water is 1:7; wherein the dyeing solution includes glacial acetic acid, a leveling agent and a penetrating agent, and the mass ratio of the glacial acetic acid to the leveling agent to the penetrating agent is 2%: 2%: 1%.

Step 4, a secondary drying operation, which includes sub-steps of placing and spreading out the semi-finished product C on a bearing panel in the drying chamber, increasing the temperature inside the drying chamber to the temperature of 185° C., maintaining the temperature for 10 min, decreasing the temperature inside the drying chamber to a temperature within the range of 50-55° C., maintaining the temperature for 5 min, and after the material gets cool, obtaining a semi-finished product D.

Step 5, a sizing operation, which includes a sub-step of loading a prepared sizing solution onto a sizing machine, wherein the ratio of the sizing solution to clean water is 1:4, and the sizing solution is prepared by the following ingredients in part by mass: 120 parts of SC-14 starch, 25 parts of LMA-95 synthetic sizing agent, 16 parts of emulsified oil and 15 parts of smoothing agent.

The sizing operation also includes sub-steps of spreading out the semi-finished product D on the sizing machine, performing sizing operation at a yarn speed of 30 m/min and a tank temperature of over 95° C., and obtaining a semi-finished product E after the sizing operation is completed; wherein the sizing solution is prepared in a weight proportion of 3.5-5 mL/Kg.

Step 6, a ternary drying operation, which includes sub-steps of placing and spreading out the semi-finished product E on a bearing panel in the drying chamber, increasing the temperature inside the drying chamber to the temperature of 140° C., maintaining the temperature for 5 min, continuously decreasing the temperature of the drying chamber to the temperature of 60° C., turning off a heating unit after size film is formed on the surfaces of the warp yarns, and after the material gets cool, obtaining a pre-fabricated product F.

Step 7, a doffing operation, which includes homogeneously spraying a softening agent onto the surface of the denim fabric, wherein the softening agent is prepared by the following ingredients in part by mass: 25 parts of sodium benzoate, 11 parts of octamethyl cyclotetrasiloxane, 10 parts of sodium stearate, 15 parts of hydroxypropyl methylcellulose, 5 parts of polyvinyl alcohol, 2 parts of sodium oleate, 2 parts of sodium tripolyphosphate, and 2 parts of lauryl sodium sulfate.

The doffing operation is carried out at a lathe speed of 40 m/min, a heating temperature within the range of 130~150° C. and a pressure within the range of 10~12 MPa, and after the material is sized, the finished product G is obtained.

For the environmentally-friendly novel color denim fabric which is dyed without water in the present application, as warp yarns are dyed using the coating spraying technology, highly corrosive auxiliaries such as sodium hydrosulfite and sodium sulfide are not needed in the dyeing process, and the dyed warp yarns do not need to be treated in a washing tank, so that zero effluent discharge is achieved.

Compared with the prior art, the present application avoids the washing operation. For white warp yarns, the present application adopts high temperature steam treatment, which can not only sterilize the raw materials at a high temperature on the one hand, but also effectively soften the raw materials on the other hand. In this way, the raw material is relatively fluffy, increasing distances between fibers.

Then, the material treated with high-temperature steam experiences plasma drying treatment. Plasma is an ionized gaseous substance consisting of atoms of which some electrons are stripped away and positive and negative ions which are generated after radicals are ionized, with a length greater than that of the macroscopically electrically neutral ionized gases in Debye length. Plasma is mainly moved by the electromagnetic force, and presents an obvious group behavior. The plasma can effectively optimize the surface structure of cotton yarns, increase the content of the hydrophilic radicals in fibers to help treat cotton yarns in dry environment.

Treating the white warp yarns in the way mentioned above can enhance the dyed pick-up by over 15%, increase the ratio of the coating adhesive, and improve the colorfastness to dry rub and wet rub by 0.5-1 grade in comparison with the national standard (colorfastness to dry rub grade 3, colorfastness to wet rub grade 2). The whole dyeing process is free of formaldehyde and other harmful substances, and can meet the SGS testing standard. The tex numbers of warp yarns of the fabric include 72tex (8 Ne), 58tex (10 Ne), 36tex (16 Ne), etc. The weft yarns are double core-spun yarns, with tex numbers of 48tex (12 Ne), 36tex (16 Ne), 28tex (21 Ne), etc., weaved in a 3/1 way. Sometimes, rearranged twill, plain wave or crepe weave denim fabric is adopted. Fabric can be endowed with a comfortable hand feel by simple post-treatment (such as desizing/sanforizing); and ready-made clothes can present a wash-fading effect similar to that of indigo and sulfur dyestuff when washed with water, applicable to various washing approaches (normal garment wash, enzyme wash, rinse, stone wash, destroy wash, etc.), The ready-made fabric processed with the method of the present invention has features of soften hand feel, good color fastness, brilliant color and luster, which solves the problems such as stiff hand feel and dull color and cluster of the traditional coating dyed fabric.

For those skilled in the art, it is apparent that the present invention is not limited to the details of the above exemplary embodiments, and other specific forms can be adopted to implement the present invention under the condition of no departure from the concept or basic features of the present invention. Therefore, the embodiment shall be deemed to be exemplary no matter viewed from which point, instead of limited. The scope of the present invention is defined by the attached Claims instead of the above description. Thus, all changes made within the definitions and scope equivalent to those of the Claims shall fall within the scope of the present invention.

Besides, it should be understood that the Description is depicted according to the embodiment, but it is not the truth that every embodiment merely includes one independent technical solution. The depiction of the Description is made for the only purpose of clearly describing the present application. The technical solutions in respective embodiments can also be properly formed to form other embodiments that can be understood by those skilled in the art.

What is claimed is:

1. An environmentally-friendly processing method for dyeing denim fabric with zero discharge, comprising:

step 1, a treatment of white warp yarns, including sub-steps of selecting white warp yarns, sewing edges of the white warp yarns using a sewing machine, removing thread residues, spreading out and placing the treated warp yarns in a Teflon drying barrel, increasing the temperature inside the drying barrel with a high-temperature steam for 10-15 min, turning off heating to let the warp yarns to cool, then placing the cooled warp yarns in a plasma barrel, and performing plasma drying treatment on surfaces of the warp yarns at normal pressure for 10-15 min, and obtaining a pre-processed material A;

step 2, a primary drying operation, including sub-steps of placing and spreading out the pre-processed material A in an drying chamber, increasing the temperature inside the drying chamber to a high operation temperature within the range of 135-150° C. first, maintaining the temperature for 30 min, then decreasing the temperature inside the drying chamber to a temperature within the range of 45-55° C., maintaining the temperature for 10 min, then turning off heating, and after the heated material gets cool, obtaining a processed material B;

step 3, a coating spray-dyeing operation, including sub-steps of placing and spreading out the processed material B in a spray-dyeing chamber, loading a spray-dyeing solvent, increasing the temperature inside the spray-dyeing chamber to a temperature within the range of 65-75° C., maintaining the temperature for 10 min, then turning off heating, performing spray-dyeing operation, and obtaining a semi-finished product C;

step 4, a secondary drying operation, including sub-steps of placing and spreading out the semi-finished product C on a bearing panel in the drying chamber, increasing the temperature inside the drying chamber to a temperature within the range of 170-190° C., maintaining the temperature for 10 min, decreasing the temperature inside the drying chamber to a temperature within the range of 50-55° C., maintaining the temperature for 5 min, and after the material gets cool, obtaining a semi-finished product D;

step 5, a sizing operation, including sub-steps of loading a prepared sizing solution onto a sizing machine, spreading out the semi-finished product D on the sizing machine, performing sizing operation at a yarn speed of 30 m/min and a tank temperature of over 95° C., and obtaining a semi-finished product E after the sizing operation is completed;

step 6, a ternary drying operation, including sub-steps of placing and spreading out the semi-finished product E on the bearing panel in the drying chamber, increasing the temperature inside the drying chamber to a temperature within the range of 130-150° C., maintaining the temperature for 5 min, continuously decreasing the temperature of the drying chamber to the temperature of 60° C., maintaining the temperature for 10 min, turning off heating after a size film is formed on the surfaces of the warp yarns, and after the heated material gets cool, obtaining a pre-fabricated product F;

step 7, a doffing operation, including sub-steps of uniformly spraying a softening agent on the surface of the denim fabric, performing doffing operation at a lathe speed of 40 m/min and a heating temperature within the range of 130~150° C. and under a pressure within the range of 10~12 MPa, and after the shape of the fabric is fixed, obtaining a finished product G.

2. The environmentally-friendly processing method for dyeing denim fabric with zero discharge according to claim 1, wherein the spray-dyeing solvent is prepared in a weight proportion of 5-10 mL/Kg, and a ratio of the dyeing solution to clean water is 1:7.

3. The environmentally-friendly processing method for dyeing denim fabric with zero discharge according to claim 2, wherein the spray-dyeing solvent comprises glacial acetic acid, a leveling agent and a penetrating agent, and a mass ratio of the glacial acetic acid to the leveling agent to the penetrating agent is 2%: 2%: 1%.

4. The environmentally-friendly processing method for dyeing denim fabric with zero discharge according to claim 1, wherein the sizing solution is prepared in a weight proportion of 3.5-5 mL/Kg, and a ratio of the sizing solution to clean water is 1:4.

5. The environmentally-friendly processing method for dyeing denim fabric with zero discharge according to claim 4, wherein the sizing solution is prepared by the following ingredients in part by mass: 120 parts of starch, 25 parts of synthetic sizing agent, 16 parts of emulsified oil and 15 parts of smoothing agent.

6. The environmentally-friendly processing method for dyeing denim fabric with zero discharge according to claim 1, wherein the softening agent is prepared by the following ingredients in part by mass: 25 parts of sodium benzoate, 11 parts of octamethyl cyclotetrasiloxane, 10 parts of sodium stearate, 15 parts of hydroxypropyl methylcellulose, 5 parts of polyvinyl alcohol, 2 parts of sodium oleate, 2 parts of sodium tripolyphosphate, and 2 parts of lauryl sodium sulfate.

7. The environmentally-friendly processing method for dyeing denim fabric with zero discharge according to claim 1, wherein the temperature for the secondary drying operation is 35-40° C. higher than the temperature for the primary drying operation, and the temperature for ternary drying operation is 35-40° C. lower than the temperature for the secondary drying operation.

* * * * *